US009058922B2

(12) United States Patent
Bleich et al.

(10) Patent No.: US 9,058,922 B2
(45) Date of Patent: Jun. 16, 2015

(54) METHOD OF MANUFACTURING CHAIN EXTENDED FOAM INSULATION COAXIAL CABLE

(71) Applicant: Andrew LLC, Hickory, NC (US)

(72) Inventors: Larry Lynn Bleich, Hickory, NC (US); Gary L Craton, Newton, NC (US); Jason A Huffman, Maiden, NC (US)

(73) Assignee: CommScope Technologies LLC, Hickory, NC (US)

( * ) Notice: Subject to any disclaimer, the term of this patent is extended or adjusted under 35 U.S.C. 154(b) by 164 days.

(21) Appl. No.: 13/849,717

(22) Filed: Mar. 25, 2013

(65) Prior Publication Data

US 2014/0284072 A1 Sep. 25, 2014

(51) Int. Cl.

| | |
|---|---|
| ***H01B 12/14*** | (2006.01) |
| ***H01B 13/24*** | (2006.01) |
| *H01B 13/06* | (2006.01) |

(52) U.S. Cl.

CPC ..... *H01B 13/24* (2013.01); *H01B 13/067* (2013.01)

(58) Field of Classification Search

CPC .. H01B 13/00; H01B 13/016; H01B 13/0013; H01B 13/24; H01B 13/067

See application file for complete search history.

(56) References Cited

U.S. PATENT DOCUMENTS

| | | | | |
|---|---|---|---|---|
| 3,072,583 | A * | 1/1963 | Randa | 521/79 |
| 3,315,025 | A * | 4/1967 | Tomlinson | 174/107 |
| 3,356,790 | A * | 12/1967 | Polizzano et al. | 174/102 R |
| 3,567,846 | A * | 3/1971 | Brorein et al. | 174/102 R |
| 3,569,610 | A * | 3/1971 | Garner et al. | 174/102 R |
| 3,693,250 | A * | 9/1972 | Brorein et al. | 29/825 |
| 4,014,770 | A * | 3/1977 | Suzuki et al. | 521/50.5 |
| 5,109,599 | A * | 5/1992 | Ohlhaber | 29/828 |
| 5,515,603 | A * | 5/1996 | Ziemek et al. | 29/828 |
| 5,946,798 | A * | 9/1999 | Buluschek | 29/828 |
| 6,156,427 | A * | 12/2000 | Gotoh et al. | 428/378 |
| 6,335,490 | B1 * | 1/2002 | Higashikubo et al. | 174/110 F |
| 6,492,596 | B1 * | 12/2002 | Higashikubo et al. | 174/137 B |
| 6,800,809 | B2 * | 10/2004 | Moe et al. | 174/102 R |
| 6,838,545 | B2 * | 1/2005 | Chapman et al. | 528/480 |
| 2008/0283271 | A1 * | 11/2008 | Kenny et al. | 174/110 F |

FOREIGN PATENT DOCUMENTS

| | | | |
|---|---|---|---|
| EP | 423995 | A * | 4/1991 |

* cited by examiner

*Primary Examiner* — Carl Arbes
(74) *Attorney, Agent, or Firm* — Babcock IP, PLLC

(57) ABSTRACT

A method for manufacturing a coaxial cable werein a polymer is irradiated and extruded around a metallic inner conductor and the polymer is then surrounded with a metallic outer conductor. The irradiated polymer may be irradiated, for example, via electron beam, for example, between 0.25 and 4 MRad.

14 Claims, 1 Drawing Sheet

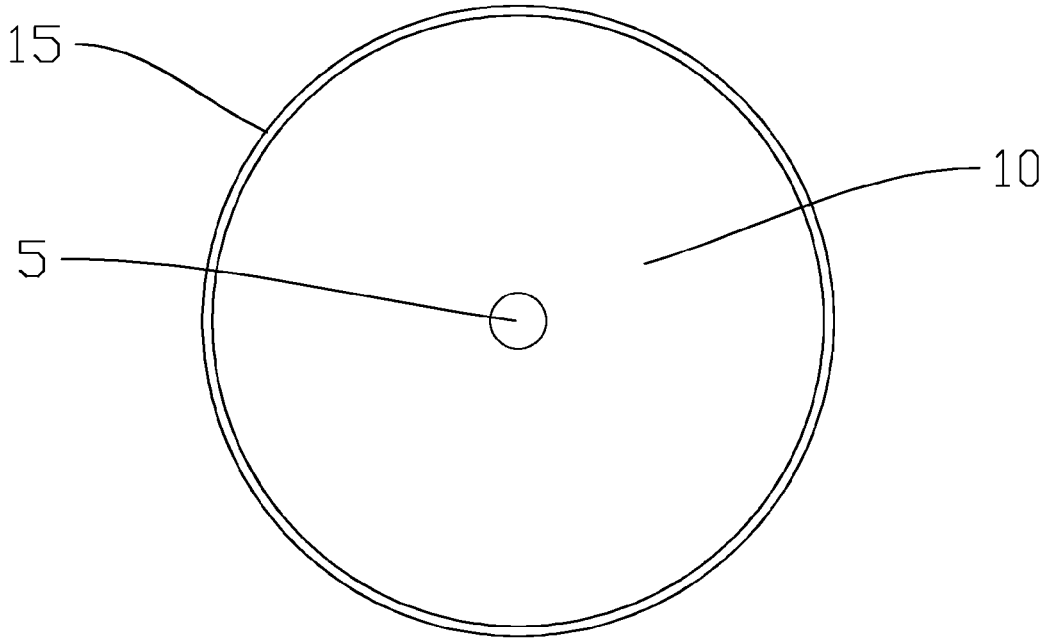
15
10
5

METHOD OF MANUFACTURING CHAIN EXTENDED FOAM INSULATION COAXIAL CABLE

BACKGROUND

1. Field of the Invention

This invention relates to foam dielectric for coaxial cables. More particularly, the invention relates to an irradiated polyethylene (PE) foam dielectric with a chain extended characteristic, enabling cost efficient manufacture of coaxial cables with, for example, improved structural characteristics and operating temperature capabilities.

2. Description of Related Art

Coaxial cables may utilize a foam dielectric to support the inner conductor coaxially within the surrounding outer conductor. The foam dielectric of conventional coaxial cables may be comprised of, for example, a blend of high density polyethylene (HDPE) and low density polyethylene (LDPE). LDPE materials selected for this application typically have long chain branches which provide a stable foaming characteristic.

LDPE provides advantages of an improved foaming characteristic while the HDPE has a higher melting temperature as well as improved strength, crush resistance and attenuation characteristics. Conventional HDPE polymer, alone, has not typically been used as the foam dielectric because it does not normally have enough elongational viscosity to stabilize bubble growth during foaming. Because of the properties of each material, a foam dielectric is typically a blend of HDPE and LDPE materials.

A nucleant is typically added to the blend of HDPE and LDPE which is then subjected to a gas during the extrusion process to assist foaming. Conventional low density foams typically use either a single gas or a mixed gas foaming agent. The mixtures used contain an atmospheric gas in combination with a second agent such as butane, pentane or a refrigerant. It should be noted that the secondary gasses mentioned are objectionable because of flammability and/or environmental concerns.

A method used to improve the melting performance of the dielectric foam with minimal impact to dielectric properties subjects the dielectric foam to an electron beam to cross-link the polymer chains. However, the cross linked polymer chains take on a thermal set and cannot be melted again for reuse.

Competition in the coaxial cable market has focused attention on improving coaxial cable physical characteristics and electrical performance while minimizing overall costs, including materials costs. It is desirable from an environmental perspective to have a foam dielectric that can be melted again for reuse and to minimize the use of environmentally objectionable secondary gasses.

Therefore, it is an object of the invention to provide a coaxial cable and method of manufacture that improves upon the prior art.

BRIEF DESCRIPTION OF THE DRAWINGS

The accompanying drawings, together with a general description of the invention given above, and the detailed description of the embodiments given below, serve to explain the principles of the invention.

FIG. 1 is a schematic cross-section view of an exemplary coaxial cable.

DETAILED DESCRIPTION

The inventors have recognized that controlled irradiation of polymers, for example PE, creates a highly desirable chain extended, also known as partly cross-linked, characteristic in the polymer that provides high levels of polymer branching resulting in significantly improved polymer foaming characteristics. Thereby, manufacture of coaxial cables with improved structural characteristics and/or thermal capacity, with reduced requirement for or elimination of PE blends including LDPE may be enabled.

The irradiation of the polymer may be performed, for example, by exposing the polymer to an electron beam. The electron beam may be applied, for example, to the raw polymer, for example in bulk pellet form. The electron beam may be applied at room temperature for some polymers or alternatively to other polymers which are heated above a glass transition temperature.

Where the raw polymer is irradiated, the irradiated raw polymer may then be stored and/or tran-shipped still in standard bulk pellet form from the irradiation location and later further processed into the foam dielectric of a coaxial cable by extrusion at another location on a conventional coaxial cable process line.

The polymers have a nucleant added to them and are subjected to a gas during the extrusion process so that the polymers are extruded around a metallic inner conductor 5 and the extruded polymer 10 is in turn surrounded by a metallic outer conductor 15 to form the coaxial cable, for example as shown in FIG. 1.

Table 1 is a chart of measured data obtained from an HDPE polymer sample in raw form and electron beam irradiated with 0.6 and 1.2 MRad doses, and an LDPE polymer sample in raw form.

TABLE 1

Comparison of Properties

| Property | Units | 0.0 MRad | 0.6 MRad | 1.2 MRad | LDPE |
|---|---|---|---|---|---|
| Dielectric Constant @ 858 MHz | Change | 0 | +1% | +0% | −2% |
| Dissipation Factor @ 858 MHZ | Change | 0 | +22% | +33% | +158% |
| Shear Viscosity | Pa-Sec | 925 | 994 | 1112 | 880 |
| Elongational Viscosity | Pa-Sec × $10^4$ | 0.82 | 6.81 | 15.7 | 11.4 |
| Melt Index | g/10 min | 7.6 | 4.2 | 1.6 | 7.0 |
| Die Swell | % | 7% | 73% | 81% | |
| Density | g/ml | 0.943 | 0.945 | 0.941 | 0.918 |
| Melt Temp | ° C. | 129 | 129 | 129 | 105 |
| Tensile Strength | Psi | 4030 | 4080 | 4150 | 1800 |
| Ult. Elongation | % | 1450 | 1440 | 1360 | 550 |

For example, where the polymer is HDPE, the level of irradiation may be preferably applied at a level of 0.25 to 4 Mrad, with a significant improvement in the elongational viscosity occurring proximate at least 0.6 Mrad, as demonstrated in Table 1. At a higher dose, the polymer may be entirely cross-linked, rather than the desired chain extended. Chain extended polymer has melt and foaming characteristics similar to raw polymer, while an entirely cross-linked polymer may no longer melt or flow for extrusion in conventional extrusion equipment configurations and temperature profiles. One skilled in the art will appreciate that the irradiation level applied may depend upon the specific polymer selected. Alternative polymers that partially cross-link upon irradiation, rather than degrade, include per-fluoropolymers and the like.

A representative sample of HDPE, DGDA-6944 Natural, available from Dow Chemical Company of Midland Michigan, was irradiated and analyzed. Measured characteristics of the polymer without irradiation and after exposure to 0.6 and 1.2 MRad via electron beam appear in FIG. 1. At 1.2 MRad, the elongational viscosity of the sample is increased by a factor of 19, compared to non-irradiated raw material. Similarly, the die swell is higher by a factor of 11. This data is compared to a representative sample of LDPE used in the industry.

One skilled in the art will appreciate that coaxial cable manufacture, including extrusion of polymer to form the foam dielectric layer, is well known in the art and as such is not disclosed in further detail herein.

The attenuation characteristic of the HDPE irradiated with 0.6 MRad is superior to the typical blends of HDPE/LDPE commonly applied as the foam dielectric in coaxial cables. Elimination and/or reduction of the prior requirement for LDPE in polymer blends for coaxial cable foam dielectric layers may improve the attenuation characteristics of the resulting coaxial cable, as well as the thermal and overall cost characteristics of the coaxial cable. Chain extension/partial cross-linking may also remove a requirement for foaming the polymer during extrusion with the assistance of secondary gases. Further, because the polymer may be irradiated and trans-shipped still in bulk form, the irradiated polymer may be applied to conventional coaxial cable manufacture process lines without additional expense and/or retooling of the process line or facility.

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A method for manufacturing a coaxial cable, comprising the steps of:

irradiating a polymer;

extruding the polymer around an inner conductor; and surrounding the foamed polymer with an outer conductor.

2. The method of claim 1, wherein the irradiating is via exposing the polymer to an electron beam.

3. The method of claim 1, wherein the irradiating is between 0.25 and 4 Mrad.

4. The method of claim 1, wherein the polymer is high density polyethylene.

5. The method of claim 1, wherein the polymer is a per-fluoropolymer.

6. The method of claim 1, wherein the irradiation is applied until the polymer is chain extended.

7. The method of claim 1, wherein the irradiation is performed upon the polymer while in pellet form.

8. The method of claim 1, wherein the irradiation is performed upon the polymer while in pellet form while the polymer is heated above a glass transition temperature.

9. The method of claim 1, wherein the extrusion is performed without addition of a secondary gas.

10. A method for manufacturing a coaxial cable, comprising the steps of:

irradiating pellets of a polymer until the polymer is chain extended;

extruding the polymer around an inner conductor; and surrounding the extruded polymer with an outer conductor.

11. The method of claim 10, wherein the irradiation is between 0.25 and 4 MRad, via an electron beam.

12. The method of claim 10, wherein the extrusion is performed without addition of a secondary gas.

13. The method of claim 10, wherein the polymer is high density polyethylene.

14. The method of claim 10, wherein the polymer is a per-fluoropolymer.

* * * * *